US006234649B1

(12) United States Patent
Katougi

(10) Patent No.: US 6,234,649 B1
(45) Date of Patent: May 22, 2001

(54) ELECTRIC LAMP DEVICE AND LIGHTING APPARATUS

(75) Inventor: Masayuki Katougi, Tokyo (JP)

(73) Assignee: Moriyama Sangyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/106,451

(22) Filed: Jun. 30, 1998

(30) Foreign Application Priority Data

Jul. 4, 1997 (JP) ..... 9-179473

(51) Int. Cl.[7] ..... F21V 1/00

(52) U.S. Cl. ..... 362/248; 362/227; 362/252; 362/255; 362/325; 362/354

(58) Field of Search ..... 362/248, 231, 362/290, 800, 327, 227, 325, 354, 252, 255; 315/200, 360, 185 R

(56) References Cited

U.S. PATENT DOCUMENTS 1,488,284 * 3/1924 Renner ..... 362/327
4,063,079 * 12/1977 Feder ..... 362/290
5,749,646 * 5/1998 Brittel ..... 362/231

FOREIGN PATENT DOCUMENTS 61-138160 8/1986 (JP) .
2-117657 9/1990 (JP) .

* cited by examiner

*Primary Examiner*—Sandra O'Shea
*Assistant Examiner*—Bertrand Zeade
(74) *Attorney, Agent, or Firm*—Venable; Robert J. Frank; Gabor J. Kelemen

(57) ABSTRACT

An electric lamp device which is capable of suppressing obstruction light toward the sky even if being used as a garden light or the like as well as a common lighting electric lamp. In the electric lamp device comprising an envelope and a small-sized light-emitting element assembly, an open end of a globe is coupled to a globe connection opening of a base body to constitute the envelope, and the small-sized light-emitting element assembly, such as a set of baseless small-sized electric lamps connected in series to each other, is housed within this envelope, and additionally, a louver including ring-like louver components is put within the envelope surrounding the small-sized light-emitting element assembly. Further, when needed, an attachment is fixed in the globe connection opening of the base body. The louver is mounted on this attachment. The attachment is composed of a plate section, a light-emitting element mounting section, and a support standing section. The small-sized light-emitting element assembly is mounted on the light-emitting element mounting section, and is supported by a support.

14 Claims, 14 Drawing Sheets

ELECTRIC LAMP DEVICE AND LIGHTING APPARATUS

BACKGROUND OF THE INVENTION

1. Field of the Invention

The present invention relates to an electric lamp device constructed by placing a plurality of small-sized light-emitting elements within an envelope including a globe and a base body, and further to a lighting apparatus using this electric lamp device.

2. Description of the Related Art

There has been known an illuminator, such as a garden light, which is for the purpose of illuminating a square, a park, an entrance of a building, a plantation around a building, or the like at a relatively low position. Although this type of illuminator has some basic configurations, an illuminator with a configuration shown in FIG. 11 has been employed in relatively many cases.

FIG. 12 is a front-elevational and cutaway cross-sectional view showing a prior garden light. In the illustration, numeral 101 denotes a lamp pipe (column), numeral 102 depicts a pedestal, numeral 103 designates a supporting frame, numeral 104 represents a socket, numeral 105 signifies a compact fluorescent lamp, numeral 106 indicates a louver means, numeral 107 stands for a globe, numeral 108 denotes a packing, and numeral 109 designates a stabilizer. The lamp pipe 101 has an internally hollow, cylindrical configuration, and in use, its proximal portion is planted into the ground. The pedestal 102 has a short cylindrical configuration with a step, and its small-diameter section 102*a* constitutes a connecting section which is inserted into the tip portion of the lamp pipe and attached through a mounting device such as screws to the lamp pipe 101, while its large-diameter section 102*b* is positioned on the tip portion of the lamp pipe 101 and constitutes a main section where the globe 107 is mounted thereon by means of a thread groove 102*b*1 made in an inner surface thereof.

The supporting frame 103 has a circular box-like configuration made such that its top has a circumferential inclined surface 103*a*, and it is fixedly secured to the interior of the pedestal 102, with it internally holding the socket 104. In a manner of being set in the socket 104, the compact fluorescent lamp 105 is brought into electrical connection with a lighting circuit including the stabilizer 109 concurrently with being mechanically held thereby. The louver means 106 is composed of a plurality of ring-like louver components 106*a* and an assembling mechanism 106*b*. Each of the ring-like louver components 106*a* is made up of an upper portion 106*a*1 and a louver portion 106*a*2 extending downwardly from the outer circumferential edge of the upper portion 106*a*1 to make an inclined configuration. The assembling mechanism 106*b* is composed of a metallic bar 106*b*1, spacers 106*b*2 and nuts 106*b*3. That is, the lower end portion of the metallic bar 106*b*1 is fixedly secured through the nut 106*b*3 to the top surface of the supporting frame 103, and the spacer 106*b*2 is fitted over the metallic bar 106*b*1, and further another louver component 106*a* is fitted over the metallic bar 106*b*1, and then, the other louver components 106*a* and spacers 106*b*2 are successively fitted over the metallic bar 106*b*1 in like manner, and finally, the nut 106*b*3 is screwed on the metallic bard 106*b*1 to assemble the louver body 106 on the supporting frame 103. The globe 107 has a top portion with a semi-spherical configuration, and its outer surface is covered with a light-intercepting coating 107*a*. In addition, it proximal portion is open, and the outer circumference of its open end portion is made to have a thread groove 107*b*. Further, its intermediate portion is made to have a cylindrical transparent light-transmitting portion 107*c*.

Furthermore, in the prior garden light described above, the outer diameter of the globe 107 is 150 mm, and the height of the pedestal 102 plus the globe 107 is 210 mm. Furthermore, the compact fluorescent lamp 105 is constructed such that its glass tube section has a width of 37.5 mm and a length of 111.5 mm.

For replacement of the compact fluorescent lamp 105, the globe is turned to be detached from the pedestal 102, and a hand is inserted into the louver body 106 to rotate the fluorescent lamp 105, thereby removing it from the socket 104. Meanwhile, so far, there has been known an electric lamp device of the type in which a plurality of small-sized electric lamps are hermetically sealed in serial or parallel connection within a glass bulb.

FIG. 13 is a front elevational view showing a prior electric lamp 1 disclosed in Japanese Unexamined Utility Model Publication No. 61-138160. In the illustration, numeral 201 represents a glass bulb, numeral 202 designates a base, numeral 203 depicts lead-in wires, numeral 204 denotes electric lamps, and numeral 205 stands for lead wires. The glass bulb 201 has a structure similar to that of a common lighting electric lamp, and is equipped with a flare stem press 201*a*.

The plurality of electric lamps 204 are connected in series to each other, and connected to the base 202 in a manner that the lead wires ending in both ends thereof are connected to the pair of lead-in wires 203. They are arranged linearly as shown in the illustration or disposed in a ring-like configuration. In addition, the aforesaid publication says that incandescent lamps, discharge lamps or the like are employed as the electric lamps 204.

Furthermore, the publication mentions that the above-described prior technique can display an excellent display effect.

FIG. 14 is a schematic illustration of a principal portion of a prior electric lamp 2 disclosed in Japanese Unexamined Utility Model Publication No. 2-117657. In the illustration, numeral 301 represents a flare stem press, numeral 302 designates a pedestal, numeral 303 indicates small lamps, numeral 304 signifies lead wires, and numeral 305 stands for splicers.

The flare stem press 301 is employed as a sealing section for a glass bulb of a common lighting electric lamp, and has, at its tip portion, a projection 301*a* for planting an anchor wire, and a pair of lead-in wires 301*b* are hermetically introduced into the glass bulb. The pedestal 302 is fixedly placed with the glass bulb (not shown) in a manner that the projection 301*a* is inserted into a central hole made at its central portion. Further, small holes are made around the central hole of the pedestal 302. The plurality of small lamps 303 are disposed on the pedestal 302, and one lead wire of each of the small lamps 303 is guided through the small hole to the area surface side of the pedestal 302, and is connected through the splicer 305 to one of the lead wires of another small lamp adjacent to the first-mentioned one lead wire on the rear surface side of the pedestal 302. The other lead wire is connected through the splicer 305 to one of the lead wires of a different small lamp adjacent thereto on the front surface side of the pedestal 302.

Furthermore, the pedestal fixing the small lamps 303 is inserted into the stem press 301 and fixed there. In this case, it is said that the fixing of the small lamps 303 becomes simple, and by applying a heat resistant paint to each of the surface of each of the small lamps 303 to color it, a lamp with multi-color light is obtainable.

In the case of the prior garden light, for lamp replacement the louver components are required to have a large inner diameter to allow the insertion of a hand, and the lamp itself is large in size. Therefore the garden lamp results in a large-sized and complicated construction, which leads to a high cost and which causes lamp replacement to be troublesome.

Meanwhile, in the case of the prior electric lamps 1 and 2, since both directly use the common lighting glass bulb, difficulty is experienced to insert a plurality of small-sized electric lamps to given positions within the glass bulb. In addition, there is a problem in making the lamp vibration proof. That is, since the prior electric lamp 1 has a small glass bulb neck portion, it is difficult to dispose the electric lamps 204 in a linear or ring-like configuration within the glass bulb. Likewise, the prior electric lamp 2 has a small glass bulb neck portion, which makes it difficult to use the pedestal 302 with a desirable dimension, and since the small lamp 303 is supported by only one lead wire thereof, the support of the small lamp 303 becomes unstable.

Moreover, in the case of the prior electric lamps 1 and 2, since the glass bulb is heated to accomplish glass welding when the glass bulb is hermetically sealed, dedicated sealing equipment becomes necessary, and parts lacking sufficient heat resistance cannot be hermetically put in the glass bulb.

SUMMARY OF THE INVENTION

Accordingly, it is an object of the present invention to provide an electric lamp device using a plurality of small-sized light-emitting elements as a light source, and of suppressing, because of containing a louver means, light directed toward the sky even if a garden light or the like is directly used in the same way as the common lighting electric lamp, and further to provide a light apparatus using this electric lamp device.

An aspect of the present invention is that an electric lamp device comprises an envelope including a globe having an open end at its one end portion and further having a transparent section and a base body having a relatively large globe connection opening at its one end portion and a relatively small power supply connection opening at its other end portion and made such that the globe connection opening is connected to the open end of the globe. A small-sized light-emitting element assembly made up of a set of a plurality of small-sized light-emitting elements connected in series to each other is housed in the envelope, with conductors at both ends being guided to the power supply connection opening side. Louver means including ring-like louver components is disposed to surround the small-sized light-emitting element assembly within the envelope; and louver supporting means for supporting the louver means at a given position are provided.

In the following description of the present invention, the definition and technical meaning of the terms to be used are as follows unless otherwise designated.

First, a description will be made of the envelope. The envelope accommodates a plurality of small-sized light-emitting elements to electrically and mechanically protect the small-sized light-emitting elements and a louver means, which will be described later. Further, the envelop is constructed as including a globe with a transparent section and a base body, and is available to optically control the light emission from the small-sized light-emitting elements when necessary.

For instance, the top portion of the globe of the envelope is made to have a light-intercepting property to cut the obstruction light toward the sky, thereby preventing trouble resulting from the light. Providing the light-intercepting property to the globe top portion is realizable by making the globe top portion itself using a light-intercepting material.

In addition, it is also possible that the top portion made of a transparent material is covered with a light-intercepting coating. The light-intercepting coating can be formed on the outer or inner surface of the globe or on both the surfaces. It is possible to make the light-intercepting coating by applying a light-intercepting paint or by depositing a metal such as aluminium.

Moreover, the top portion of the globe can be made to provide a light-diffusing property to make the light passing through the top portion have a non-directional characteristic. As a way of offering the light-diffusing property to the globe top portion, there is a method in which the top portion is made of a material with a light-diffusing property, or a method that one of a coating with a light-diffusing characteristic, a rough-surface section, a rock-like pattern and a prism is formed on the outer or inner surface of a transparent top portion or on both the surfaces.

That the globe has a transparent section signifies that the globe has a transparency at least its portion for guiding light in a desired direction, and the transparency means that, if the interior of the globe is visible from the external, the light-diffusing property can somewhat be given thereto. In addition, the desired direction does not necessarily signify all the horizontal and vertical directions from the entire globe circumference, but allows a partial angular range in any one of the directions.

Furthermore, the transparency does not always signify a colorless and transparent condition, but permits a colored but transparent condition.

Limitation is not imposed on the materials for the envelope as long as the globe is made from a glass, or a transparent synthetic resin such as a polycarbonate resin or the like to have an insulating characteristic and to have some mechanical strength and includes at least a transparent portion for light guiding.

Still further, it is preferable that the base body is made of a synthetic resin, such as a BMC (bulk molding compound) being a mixture of a polyester resin and an inorganic filler, a polyethylene terephthalate resin and a polyamide resin. However, it is also possible that it is made of a glass or a material other than the glass, if required.

A preferable structure of the envelope is such that the globe is made of a glass which has at least a transparent section with an excellent transparency, while the base body is made of a synthetic resin with an excellent moldability. However, for the formation of the synthetic resin into the globe, it is possible to employ an acrylate resin, a polycarbonate resin or the like with an excellent transparency for at least the transparent section. The base body is allowed to have a light-transmitting property but also allowed to have a non-transparent property.

The connection between the globe and the base body can be made various ways such as an adhesive, welding, a mechanical engagement. However, in cases where a charging section such as a conductor of a serial array of small-sized electric lamps with no base is exposed when the globe is detached, it is preferable that the globe is designed not to be undetachable from the base body.

A base such as a screw base according to the same specification as that for the common lighting electric lamps can be mounted in the power supply connection opening of the base body. Furthermore, if both the ends of the small-sized light-emitting element assembly are connected to the base in a common way, when the electric lamp device according to this invention is mounted on an electric lamp socket, it can be used with the same sense as the common lighting electric lamp.

It is also appropriate that a light apparatus body such as a spike and a pole is directly coupled to the power supply connection opening to constitute a lighting apparatus without mounting of the base on the power supply connection opening. In this case, both the ends of the small-sized light-emitting element assembly can directly be coupled to a power supply.

Incidentally, if necessary, it is also appropriate that a base is mounted to the power supply connection opening of the electric lamp device according to this invention, a socket is set to the lighting apparatus body and the electric lamp device according to this invention is mounted on the socket, thus composing a light apparatus.

The configuration of the envelope can be the same shape as that, such as a PS type or G type, of the common lighting electric lamp if it will not interfere with the housing of a louver body which will be mentioned later, but a T type similar to a bulb type fluorescent lamp is also acceptable if needed. In this invention, no limitation is imposed on the configuration of the envelope.

In addition, the formation of a photocatalyst film on the outer surface of the envelope can dissolve fouling substances on the envelope to possibly suppress or remove its contamination. As the photocatalyst, there can be employed a membrane mainly based upon anayase type titanium oxide. In the case that the small-sized light-emitting elements housed in the envelope performs emissions including shorter wavelengths below 340 nm, the light irradiation to the photocatalyst film by the illumination light from the interior of the envelope can activate the photocatalyst film. On the other hand, even in the case that the small-sized light-emitting elements do not offer an emission needed for the activation of the photocatalyst, if it is exposed to the sun light during daytime, the activation of photocatalyst is possible.

Secondly, a description will be taken hereinbelow of the small-sized light-emitting element assembly. The small-sized light-emitting elements can be an incandescent lamp, a discharge lamps or a light-emitting diode, and no particular limitation is imposed on its type. Further, the small-sized light-emitting elements are not limited in their emission color, and there is no need for a plurality of small-sized light-emitting elements to provide the same emission color. For instance, it is also possible that the emissions of red R, green G and blue B are well balanced to look white.

The "assembly" signifies that a plurality of light-emitting elements are disposed at a short interval to take a compact profile, and it is particularly preferable that, when viewed from one given small-sized light-emitting element, two or more small-sized light-emitting elements different therefrom are arranged at a short interval. The "short interval" means a distance below approximately 1.5 times the length of the cases of the small-sized light-emitting elements, preferably below the length, and it is also acceptable that the small-sized light-emitting elements are brought into contact with each other. However, if they are separated by an adequate distance from each other, the heat generating sections can be scattered to reduce the temperature rise.

In this invention, the plurality of small-sized light-emitting elements are connected in series to a power supply, which can offer convenience in employing small-sized light-emitting elements with a low rated voltage. However, where the number of small-sized light-emitting elements necessary for ensuring a desired light emission quantity does not coincide with the number of serial connections conforming with the power supply voltage, some of the elements connected in series can be re-coupled in parallel to the power supply.

For the serial connections of the small-sized light-emitting elements, the external led wires of the same elements may be directly connected to each other or the connections therebetween may be accomplished through appropriate connecting members such as different conductors.

Furthermore, the description shifts to the louver means. The louver means includes a plurality of ring-like louver components. The ring-like louver components surround the small-sized light-emitting element assembly so that it stands within their rings. Further, in the case of using a plurality of ring-like louver components, they are disposed to be separate from each other along the axial direction of the envelope.

The ring-like louver components are not limited in their configuration except being a ring-like configuration, and their configuration can be set adequately to provide a desired light distribution. For example, in order to limit the upward light distribution, the louver surface may be inclined outwardly toward the power supply connection opening side of the base body. It is also possible that the louver surface takes a horizontal condition without being inclined in order to emphasize the horizontal light distribution.

Moreover, it is also acceptable that the louver surface is inclined outwardly to the top portion side of the globe. In this case, when the electric lamp device according to this invention is turned on in a state where the power supply connection opening is directed upwardly, the light distribution to the sky is suppressible. On the contrary, when the lighting direction is reversed, the downward light distribution is suppressed so that emphasis can be on the upward light distribution.

The surface condition of the ring-like louver components can adequately be set as desired. That is, the surfaces of the ring-like louver components can be constructed to have a light-intercepting characteristic, or to have a light-reflecting characteristic, for example, which is given by white-based coloring. The material for the ring-like louver components may be a metal or a synthetic resin.

Finally, the description advances to an operation of this invention. Since the electric lamp device according to this invention is such that a plurality of small-sized light-emitting elements are connected in series to each other to establish a small-sized light-emitting element assembly which in turn, is surrounded by a louver means within an envelope, when the base is mounted on a power supply connection opening of a base body, in a manner that it is merely set in a socket as well as a common lighting electric lamp, as in the prior garden light, it is possible to provide a light effect that appropriate light distribution control becomes feasible, for example, such that the upward light distribution is suppressible by the louver means.

Meanwhile, even if its structure is that the power supply connection opening is directly mounted on the lighting apparatus through no mounting of the socket, the same light effect is basically attainable.

Nevertheless, in this invention, miniaturization is possible up to the same dimension as that a common lighting electric lamp or a bulb type fluorescent lamp, which can lead to a considerably small-sized lighting apparatus. In addition, the construction of the lighting apparatus becomes simplified and it is producible at a low cost.

Furthermore, since a plurality of small-sized light-emitting elements are placed as an assembly within the globe, the lighting can provide a sense of glittering, and because the louver means excellently displays the light-controlling function for the emission of the respective small-sized light-emitting elements, the light distribution of the whole electric lamp device is desirably controllable.

Still further, in this invention, since small-sized light-emitting elements with a low rated voltage are connected in series to each other, it makes an electric lamp device replaceable with a common lighting electric lamp whose rated dissipation power is 20 to 100 W.

Another aspect of this invention is that an electric lamp device comprises an envelope including a globe having an open end at its one end portion and further having a transparent section and a base body having a relatively large globe connection opening at its one end portion and a relatively small power supply connection opening at its other end portion and made such that the globe connection opening is connected to the open end of the globe. An attachment having a plate section fitted in the globe connection opening of the base body and a light-emitting element mounting section; a small-sized light-emitting element assembly made up of a set of a plurality of small-sized light-emitting elements, mounted on the light-emitting element mounting section of the attachment and housed in the envelop; louver means including ring-like louver components disposed to be separated from each other in an axial direction of the envelope and to surround the small-sized light-emitting element assembly within the envelop; and louver supporting means for supporting the louver means at a given position are provided.

The feature of this construction according to the present invention is that the small-sized light-emitting element assembly is housed in the envelope through the use of the attachment.

First, a description here will begin with the attachment. The attachment supports the small-sized light-emitting elements and plays a role of an electrical connection to a power supply. The plate section of the attachment is fitted in the inside of the large globe connection opening of the base body. Preferably, it forms a closed space in cooperation with the globe.

Furthermore, the attachment is fixedly secured to the base body through a fixture such as a screw or adhesive. In addition, the connecting portions to the globe and the base body are adhered, and the attachment is fixed to the base body, so that waterproofing becomes easy. Also, the light-emitting element mounting section of the attachment supports the small-sized light-emitting elements and guides the conductors of the small-sized light-emitting element assembly toward the power supply connection opening.

Still further, in the case of use of a support for mechanically supporting the small-sized light-emitting element assembly, when needed, a support standing section is provided in the attachment. This standing section is a section by which the support stands, and the standing section can be provided in a separate condition from the attachment or integrally therewith. That is, in this case, the support rises from the attachment to mechanically support the small-sized light-emitting element assembly.

A concrete configuration of a support to support the small-sized light-emitting element assembly is not subjected to any limitation. For instance, it is possible to directly support the small-sized light-emitting elements or to support conductors for the connection between the small-sized light-emitting elements.

On the other hand, it is also acceptable that a plurality of projections are made on the attachment to support the small-sized light-emitting element assembly so that it is placed away by a given distance from the attachment. Whereupon, the small-sized light-emitting elements are disposed in a scattered fashion at the central section of the envelope, thereby avoiding the partial excessive temperature rise of the envelope when the electric lamp device goes on. In addition, by inhibiting the attachment from approaching extremely close to the small-sized light-emitting elements, the excessive temperature rise of the base body is preventable.

Furthermore, a description will be given hereinbelow of the small-sized light-emitting element assembly. In this invention, the small-sized light-emitting elements of the small-sized light-emitting element assembly can be connected in series or in parallel to the power supply. When the rated voltage of the small-sized light-emitting elements is lower than the power supply voltage, the series connections may be done. On the other hand, if being equal to the power supply voltage, the parallel connections may be employed. Further, if the number of small-sized light-emitting elements required for the desired light emission quantity does not correspond to the rated voltage therefor, some of the series connections can be shifted to the parallel connections.

Still further, the description advances to its operation. In this invention, since the attachment is fitted in the globe connection opening of the base body of the envelope, the space for housing the small-sized light-emitting elements can readily be brought into an airtight or liquidtight condition by means of the globe and the attachment. Accordingly, it is possible to provide an electric lamp device having a necessary airtightness or liquidtightness for the outdoor use.

In addition, the small-sized light-emitting element assembly is mounted on the attachment, which makes the assembling facilitated and further allows the small-sized light-emitting element assembly to be easily supported at a given position within the envelope.

Besides, since the louver means is also supported by the attachment and the louver supporting means, easier assembling is achievable.

A different aspect of this invention is that an electric lamp device comprises an envelope including a globe having an open end at its one end portion and further having a transparent section and a base body having a relatively large globe connection opening at its the one end portion and a relatively small power supply connection opening at its other end portion and made such that the globe connection opening is connected to the open end of the globe. A base mounted in the power supply connection opening of the base body; a small-sized light-emitting element assembly made up of a set of a plurality of small-sized light-emitting elements and housed in the envelope; louver means including ring-like louver components disposed to be separated from each other in an axial direction of the envelope and to surround the small-sized light-emitting element assembly within the envelope; and louver supporting means for supporting the louver means at a given position are provided.

This invention features that the envelope is equipped with a base. The base will be described hereinbelow. As the base, a known type is available according to circumstances, for example, a screw (E) base, a bayonet (BA) base, a pin (G, GX or the like) base and an R base. In addition, proper selection is possible for the base size.

Furthermore, in this invention, since the base is mounted in the power supply connection opening of the base body of the envelope, the device is usable like a common lighting electric lamp.

A different aspect of this invention is that the electric lamp device described above is constructed such that each of the light-emitting elements of the small-sized light-emitting element assembly is a baseless small-sized electric lamp.

Presently, as a small-sized light-emitting element for lighting, a small-sized incandescent lamp can most easily provide a desired light quantity. Of the small-sized incandescent lamps, a baseless small-sized electric lamp is most suitable. For this reason, the following description will be made of the baseless small-sized electric lamp.

The "baseless" signifies an electric lamp not using a metallic or synthetic-resin made base, and for example, there exist a pinch seal structure in which an end portion of the bulb is pinch-formed for sealing, a bead sealing structure in which the sealing is accomplished with a bead glass, a structure in which an end portion of the glass bulb is heated and melted by a burner for sealing, and other structures. Further, for the external lead wire processing, it is acceptable to employ a wedge base structure in which external lead wires are placed to extend along a pinch sealing section, a structure in which external lead wires are made to protrude from a sealing section in a bulb axis direction to form a linear or loop configuration, or other structures.

The "small-sized" of the baseless small-sized electric lamp signifies an electric lamp which is small in size and volume as in the case of a wedge base type electric lamp, a sub-miniature type electric lamp or the like and which goes on at a low nominal rated voltage below approximately ⅓ of the main power supply voltage. Although the bulb can take various configurations, preferably it has an elongated configuration, such as a T type bulb. For the lead-through of the external lead wires, a double-end sealing structure guiding them to the external is preferable, but a one-side sealing structure is also acceptable.

The "electric lamp" of the baseless small-sized electric lamp means an incandescent lamp where a filament is hermetically encased within the bulb. An inactive gas is sealed in the bulb, and particularly, if sealing krypton or xenon gas, this gas has a heavy atomic weight and a low heat conductivity to reduce the thermal loss in the interior of the electric lamp, and hence, desirable results are obtainable which show size reduction, prolonged life and high efficiency of the electric lamp. In addition, as the pressure of the sealed gas increases, the above-mentioned tendencies grow. Naturally, there is a need for a bulb structure which can withstand a high gas pressure at a high temperature at lighting.

Still further, the baseless small-sized electric lamp goes on at a low voltage, and has a larger and shorter filament as compared with a common lighting electric lamp, its life is long and shows strength against vibrations.

Moreover, a preferable means to assemble the respective baseless small-sized electric lamps is such that the bulb axes are arranged to be in parallel to each other and disposed on the same circle, more preferably, at an equal interval. Further, if the baseless small-sized electric lamp axes are placed to coincide with the axis of the envelope in housing them in the envelope, then its appearance becomes good and a compact electric lamp is obtainable. However, a portion of the baseless small-sized electric lamps can be shifted with respect to the remaining baseless small-sized electric lamps. In this case, although the length of the envelope in its axial direction becomes somewhat longer, the light eclipse occurring between the baseless small-sized electric lamps is reducible so that the effective light quantity increases.

When the total sum of the nominal rated voltages of the baseless small-sized electric lamps is set to be slightly higher than the nominal power supply voltage, the emission efficiency slightly comes down, but it makes almost no difference. But, in this case, the life of the electric lamp further increases. "The total sum of the nominal rated voltages of the baseless small-sized electric lamps set to be slightly higher than the nominal power supply voltage" is commonly in the range of 100 to below 120%, preferably in the range of 100%±5%.

Furthermore, since the baseless small-sized electric lamp comes on at a low voltage, a long-life design is essentially feasible, and the rated life reaches 5000 to 30000 hours in the case of ac lighting. In addition, this type of electric lamp has been used for motor vehicles, acoustic equipment and others, and therefore, electric lamps with less variation in life and with a high reliability are easily obtainable, so that their series connection does not significantly destroy their reliability.

Accordingly, the electric lamp device according to this invention can provide a considerably longer life as compared with a common lighting electric lamp.

Still further, if the baseless small-sized electric lamp is of a type of sealing krypton or xenon gas, it is possible to certainly ensure the long life.

A further different aspect of this invention is that, in the electric lamp device mentioned above, each of the baseless small-sized electric lamps is of a double-end sealing type where its filament substantially extends in parallel to the axis of the globe, and the louver means is constructed such that the ring surfaces of its ring-like louver components are disposed to cross the filament.

The double-end sealing type baseless small-sized electric lamp is made such that the filament extends in the axial direction of the T type bulb, and if the T type bulb is placed in parallel to the axial direction of the globe, the filament is in parallel to the axial direction of the globe. That is, in this invention, since the filament extends along the axial direction of the globe, the ring surface of the ring-like louver component of the louver body is located to intersect with the filament, the light of the baseless small-sized electric lamp is effectively controllable.

A further different aspect of this invention is that, in the electric lamp device mentioned above, the small-sized light-emitting elements are baseless small-sized electric lamps in which xenon is sealed in the glass bulb.

The baseless small-sized electric lamp containing the sealed xenon provides a high emission efficiency and a long life, and further offers a high emission color temperature and a relatively white color light.

A further different aspect of this invention is that, in the electric lamp device mentioned above, the louver supporting means is constructed with a plurality of wire rods in which their proximal portions are fixed to the base body side and their intermediate sections support the ring-like louver components. The wire rods are suitably made from a metal such as stainless steel, nickel, brass, on chrome plated steel, which has a moderate rigidity and resiliency.

The proximal portion of the wire rod can be fixed directly to the base body of the envelope or, in the case of using an attachment, can be fixed to the attachment to be indirectly fixed to the base body.

For supporting the ring-like louver components at the middle sections of the wire rods, a small hole is made at the supporting position of the ring-like louver component to accept the insertion of the wire rod, and in the case that the ring-like louver component is made of a metal, it is fixed through welding or soldering, and in the case of being made of a synthetic resin, it is fixed by using an adhesive or the like.

This invention presents a simple supporting structure for the ring-like louver components.

A further different aspect of this invention is that, in the electric lamp mentioned above, the louver supporting means is constructed such that the tip portion of the wire rod is placed into resilient contact with the inner surface of the globe.

No limitation is imposed on a concrete construction for bringing the tip portion of the wire rod into resilient contact with the inner surface of the globe, the simplest way may be that the tip portion of the wire rod is bent so that the wire rod comes into contact with the globe through its bent portion. In this case, the bent portion can always be placed into contact with the globe, or can normally be placed in non-contact condition but being brought into contact with the globe by vibrations.

This invention provides a structure for supporting the louver body with an excellent vibration proof.

A further different aspect of this invention is that, in the electric lamp mentioned above, the open end of the globe is adhered to the globe connection opening of the base body. As the adhesive, a silicone-based adhesive, an epoxy-based adhesive or the like is available.

In this invention, the adhesion of the globe to the base body can prevent the globe from coming out carelessly, so that no interference occurs even if a charging section for the small-sized light-emitting elements or the like is exposed in the globe. Further, it is possible to seal through the adhesion between the globe and the base body to set up an airtight or liquidtight condition.

A further different aspect of this invention is that, in the electric lamp mentioned above, the globe is, at its top portion, equipped with a light-intercepting means. The description of the light-intercepting will be omitted because of its being already done above.

The top portion of the globe not only has a hemispherical or flat configuration, but also has a different arbitrary configuration. Of course, the cross section of the globe in its axial direction can assume an arbitrary configuration, such as a cylindrical or rectangular tube-like configuration or the like. If a reflecting means is formed on the inner surface side of the light-intercepting means on the top portion of the globe, it is possible to increase the effective light quantity contributing to the desired lighting.

In this invention, when the electric lamp device is turned on in a state where its top portion is directed upwardly, owing to the light-intercepting means on the top portion of the globe, the light emitted to the sky is cut by the light-intercepting means, with the result that it is possible to eliminate the obstruction light toward the sky, thus achieving high-quality lighting.

A further different aspect of this invention is that, in the electric lamp mentioned above, the light-intercepting means on the top portion of the globe is made by a metal deposited film. As the metal deposited film, it is preferable to use aluminium, silver or the like which is a metal with a high reflectance.

In this invention, since the metal deposited film is used as the light-intercepting means, the light interception and increase in the effective light quantity are realizable.

A further different aspect of this invention is that, in the electric lamp mentioned above, the globe is substantially transparent as a whole, and the louver means includes a top louver component positioned on a further globe top portion side with respect to the ring-like louver components.

The top louver components are for the purpose of blocking the light emitted from the small-sized light-emitting element assembly to the globe top portion side, and preferably, concurrently with the light interception, reflection works as the effective light. Thus, it is desirable that the inner surface configuration and inner surface reflectance of the top louver components are set considering the reflection. For instance, a light-intercepting plate member of the top louver component is formed to have a hemispherical configuration or a curved surface constituting a portion of a sphere, and its inner surface is covered with a metal deposited film or while painted film to provide a reflecting characteristic.

The material of the top louver component can be the same as that of the ring-like louver component, that is, a metal, a synthetic resin or the like. In the case of using a material such as aluminum with a high reflectance, the as-produced material can also be used directly.

In this invention, since the top louver components are mounted on the louver means, without mounting the light-intercepting means on the top portion of the globe, the light toward the top portion is blocked to suppress the obstruction light. Accordingly, the appearance further improves.

A further different aspect of this invention is that, in the electric lamp mentioned above, the louver means is constructed such that the ring-like louver component has a louver surface inclined toward the power supply connection opening of the base body.

In this invention, since the louver surface is inclined toward the power supply connection opening side of the base body, the light distribution to the power supply connection opening side is emphasized, and on the contrary, the light distribution to the top portion side of the globe is suppressed. Accordingly, when the electric lamp device is turned on in a state where the power supply connection opening of the base body is directed downwardly, good illumination can be made chiefly to the foot side, so that, when serving as a garden light, a necessary light distribution is feasible.

A further different aspect of this invention is to provide a lighting apparatus comprising a lighting apparatus body and the electric lamp device, described above, supported by the lighting apparatus body.

In this invention, since in the electric lamp device to be used as a light source the louver means is housed in the interior of the globe, an outdoor type like the garden light is suitably employed as the lighting apparatus body, but if utilizing the light controlling effect of the louver means, an indoor type can also be used instead. That is, as an example of the outdoor lighting apparatus, there is a spike light with a structure including a pole whose tip portion has a socket and whose proximal portion stands from an installation surface and a stand standing from a pedestal and having a socket at its tip portion, with it having a pointed proximal portion useful for the insertion into the ground and being constructed to fixedly hold the electric lamp device according to this invention at its tip portion.

In addition, when needed, this invention is applicable to various kinds of lighting apparatus involving a common incandescent lamp.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
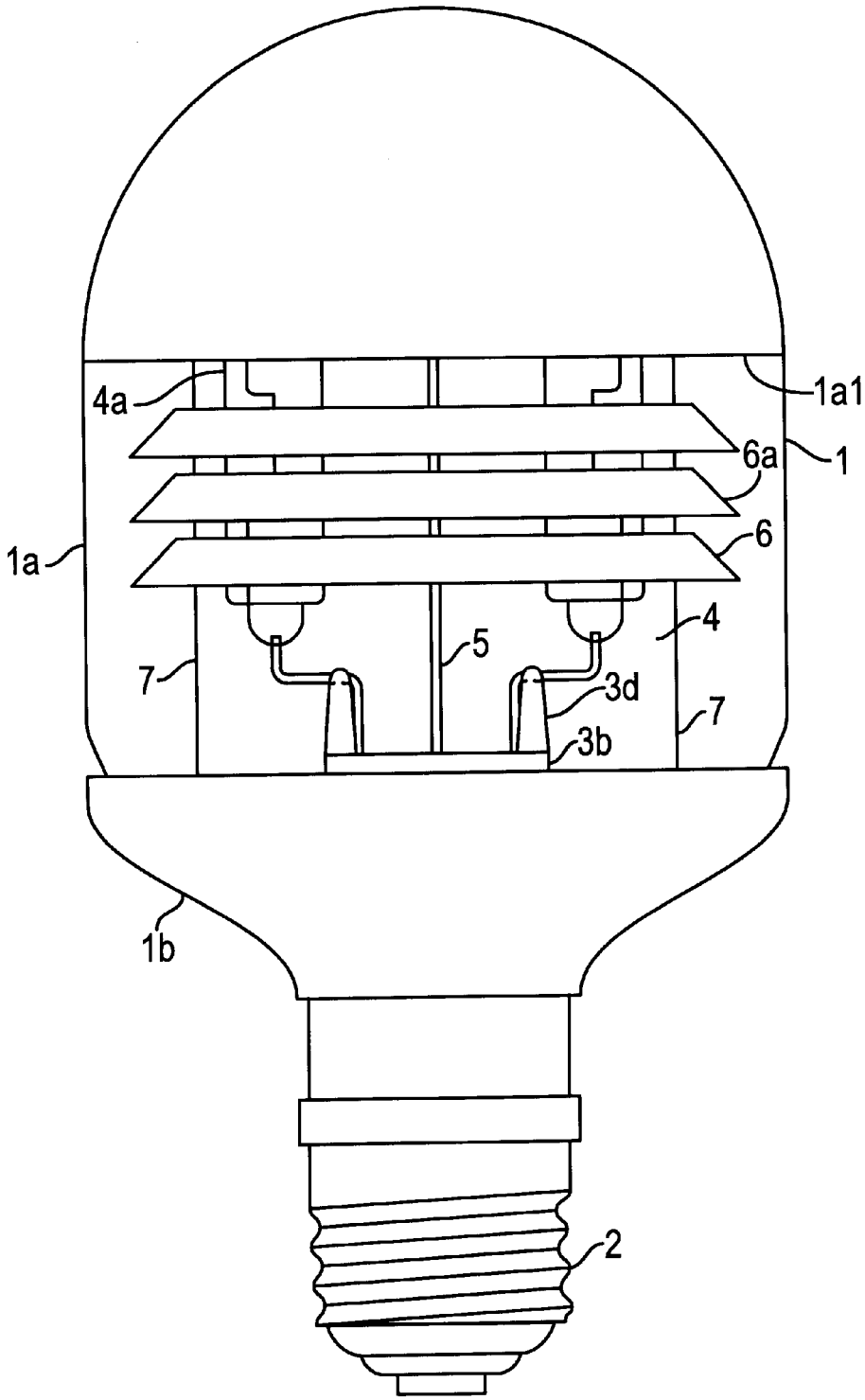
FIG. 1 is a front elevational view showing an electric lamp device according to a first embodiment of the present invention.

Referring to the drawings, a description will be made hereinbelow of embodiments of the present invention.

Figure 2:
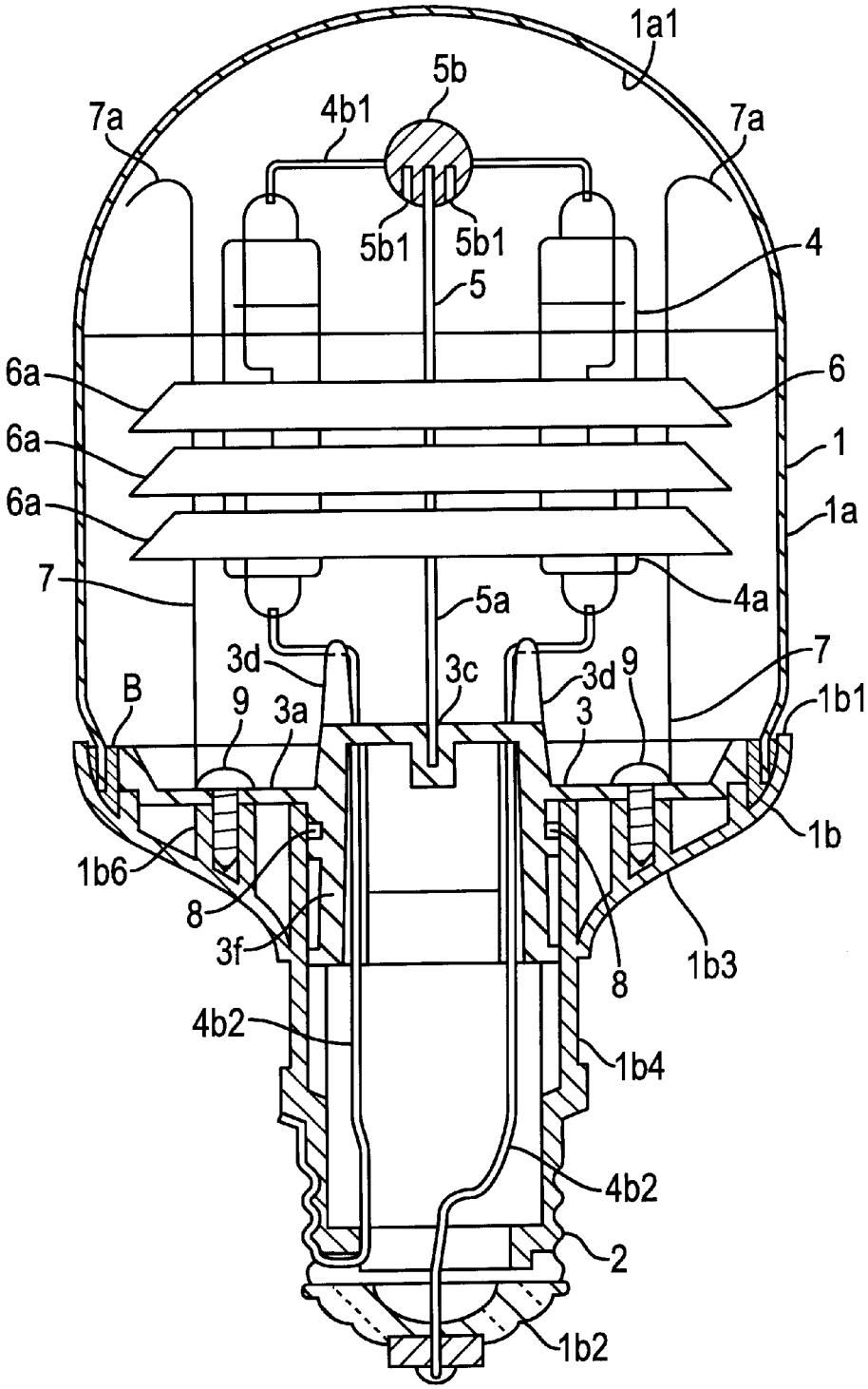
FIG. 2 is a cross-sectional view showing the same.
Figure 3:
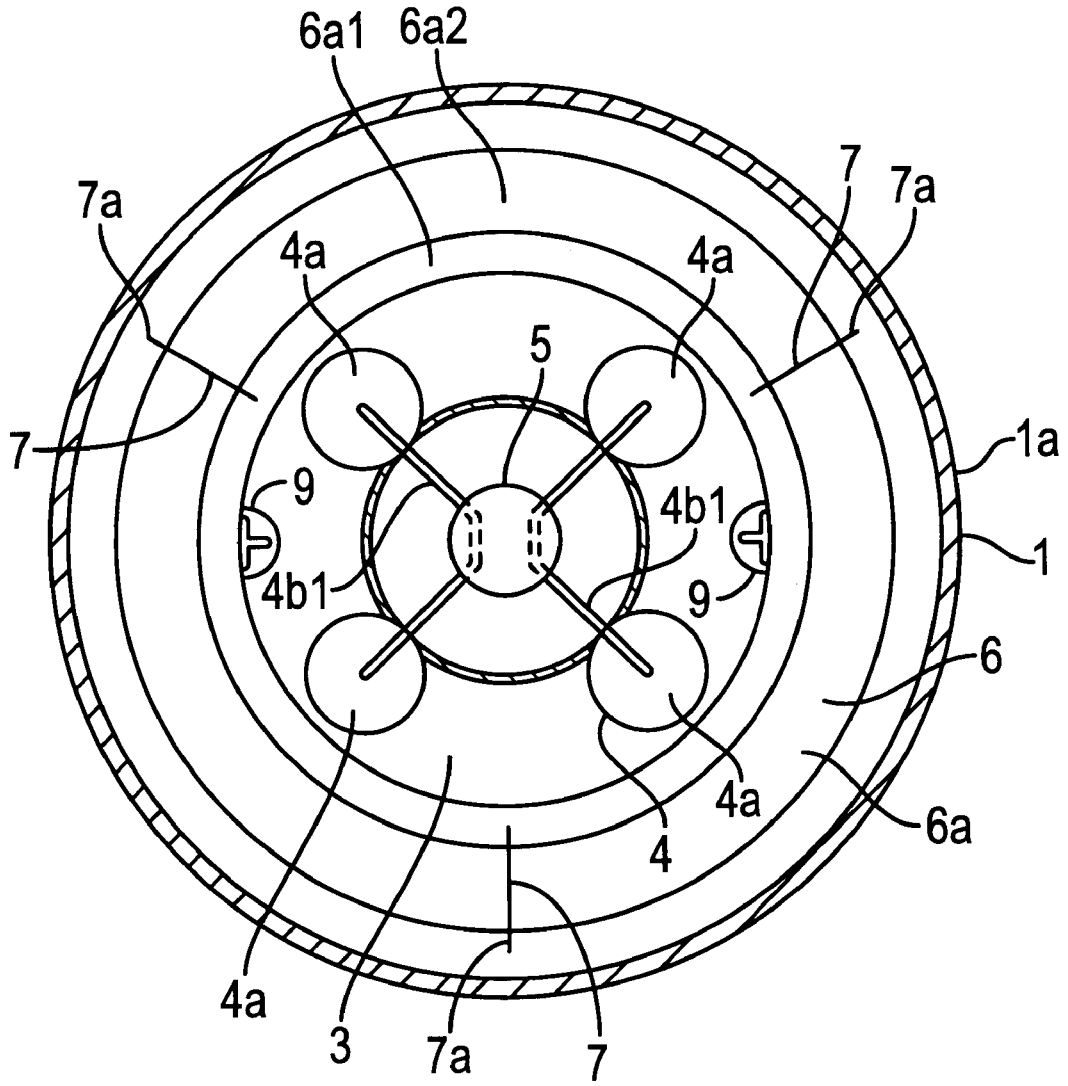
FIG. 3 is a partially cross-sectional and plan view showing the interior thereof, where only a globe is broken at an intermediate position.

FIG. 1 is a front elevational view showing an electric lamp device according to a first embodiment of the present invention, FIG. 2 is a cross-sectional view showing the same, and FIG. 3 is a partially cross-sectional and plan view showing the interior thereof, where only a globe is broken at an intermediate position.

In the illustrations, numeral 1 represents an envelope, numeral 2 designates a base, numeral 3 denotes an attachment, numeral 4 depicts a small-sized light-emitting element assembly, numeral 5 signifies a support, numeral 6 stands for a louver means, numeral 7 indicates a louver supporting means. In this embodiment, the envelope 1 is, as shown in FIG. 1, composed of a globe 1*a,* and a base body 1*b* which is in connection with an open end portion of the globe 1*a*.

First, a description will be made hereinbelow of the globe 1*a*. The globe 1*a* is made from a transparent glass to have a T-like configuration, and its top portion is shaped into a nearly semi-spherical configuration, with a light-intercepting means 1*a*1 being formed on its inner surface. The light-intercepting means 1*a*1 is constructed with an aluminium deposited film.

The base body 1*b* is, as shown in FIG. 1, molded with a virtually light-intercepting material based on a BMC material. Further, it is, at its one end portion, equipped with a relatively large globe connection opening 1*b*1 to be brought into connection with an open end of the globe 1*a,* and is, at its the other end portion, equipped with a relatively small power supply connection opening 1*b*2, and further is, at its intermediate portion, provided with a skirt section 1*b*3 and a guiding cylindrical section 1*b*4 communicating with the power supply connection opening 1*b*2 and open toward the globe connection opening 1*b*1 within the base body 1*b*. A circumferential groove 1*b*5 is made in the globe connection opening 1*b*1. An adequate number of bosses 1*b*6 with holes are formed integrally on the inner surface side of the skirt section 1*b*3. A thread groove 1*b*7 is made around the power supply connection opening 1*b*2.

For the connection of the globe 1*a* to the base body 1*b,* a silicone adhesive B is put in the circumferential groove 1*b*5 of the base body 1*b,* and then the open end 1*a*1 of the globe 1*a* is inserted into the circumferential groove 1*b*5. The solidification of the adhesive B completes the envelope. As will be described herein later, the circumferential edge of the attachment 3 enlarges the circumferential groove 1*b*5 in cooperation with the base body 1*b,* and hence, the globe 1*a* is also adhered to the attachment 3 in an airtight condition. Thus, in this case, the adhesive B is also in charge of a waterproof seal means for waterproof-sealing between the globe 1*a* and the attachment 3.

Figure 4:
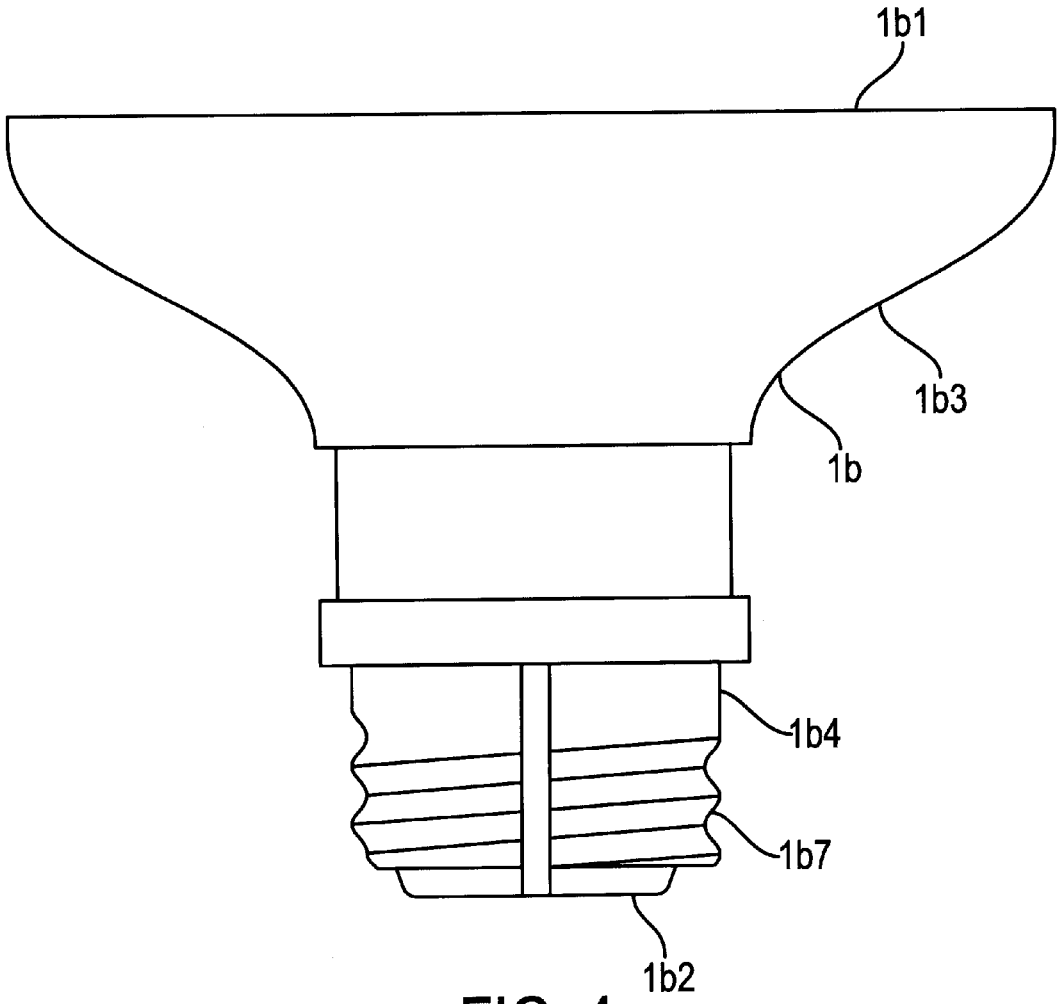
FIG. 4 is a front elevational view showing a base body of the electric lamp device according to the first embodiment of this invention.
Figure 5:
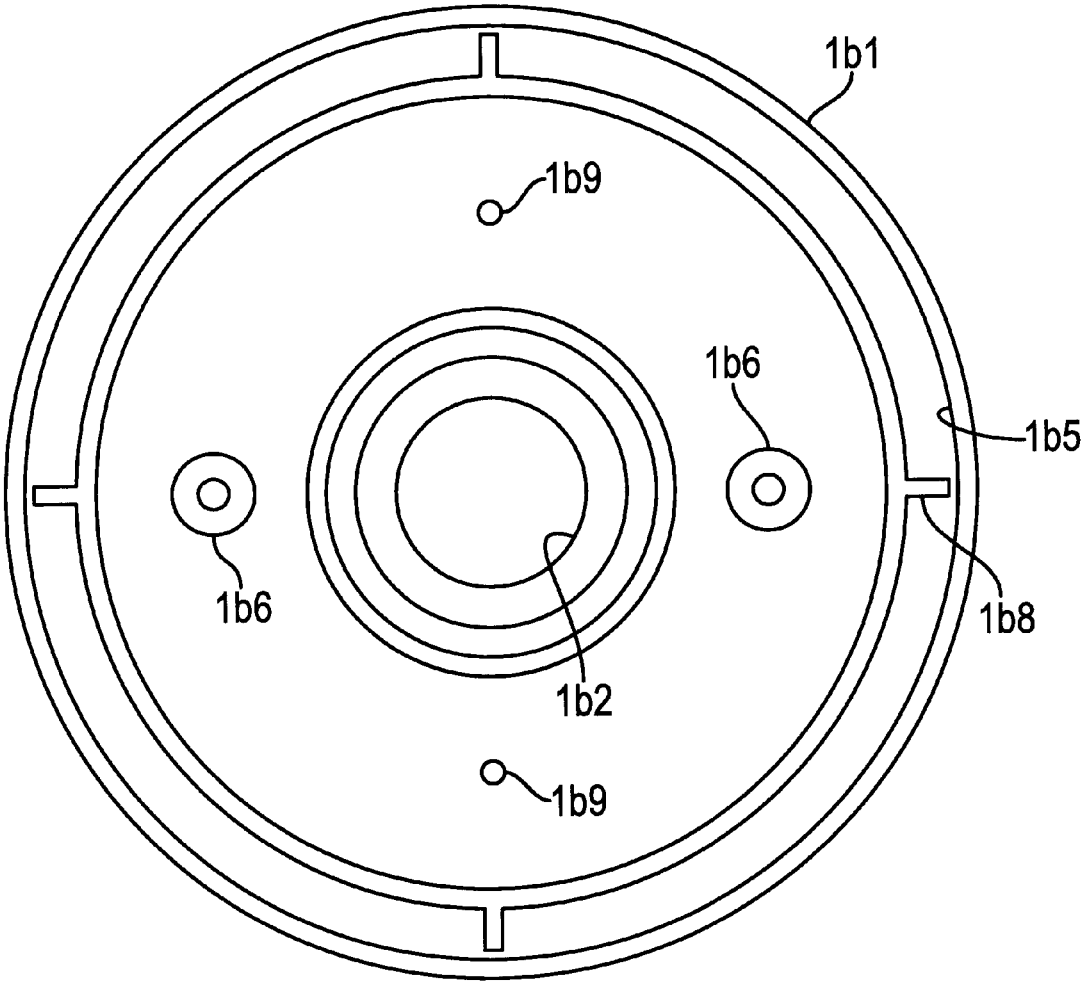
FIG. 5 is a plan view showing the same base body.

FIG. 4 is a front elevational view showing a base body of the electric lamp device according to the first embodiment of this invention, and FIG. 5 shows the same base body.

The base body 1*b* has the following structure in addition to those as described with reference to FIGS. 1 to 3. That is, within the circumferential groove 1*b*5 of the globe connection opening 1*b*1, several frame portions 1*b*8 for floating the globe 1*a* are integrally disposed scatteringly. In the skirt section 1*b*3 of the base body 1*b,* there is made small holes 1*b*9 penetrating the skirt section 1*b*3. These small holes 1*b*9 are for the purpose of escaping the pressure in a space defined by the globe 1*a* and the attachment 3 to the external as will be described herein later.

The following description switches to the base 2. The base 2 is of a screw E26 type, which is screwed in the screw groove 1*b*7 to be mounted in the power supply connection opening 1*b*2.

The description further advances to the attachment 3.

Figure 6:
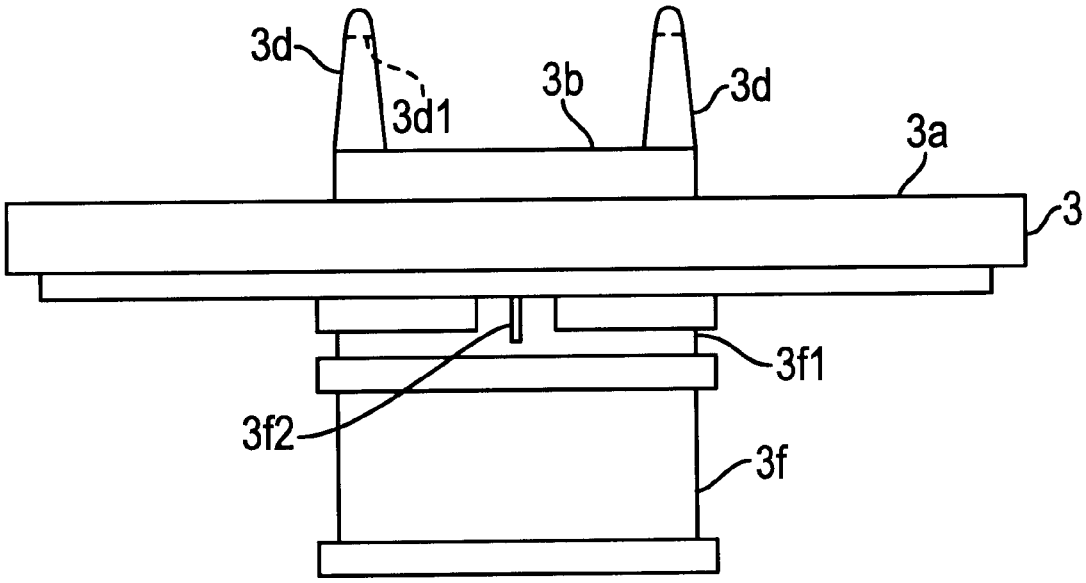
FIG. 6 is a front elevational view showing an attachment of the electric lamp device according to the first embodiment of this invention.
Figure 7:
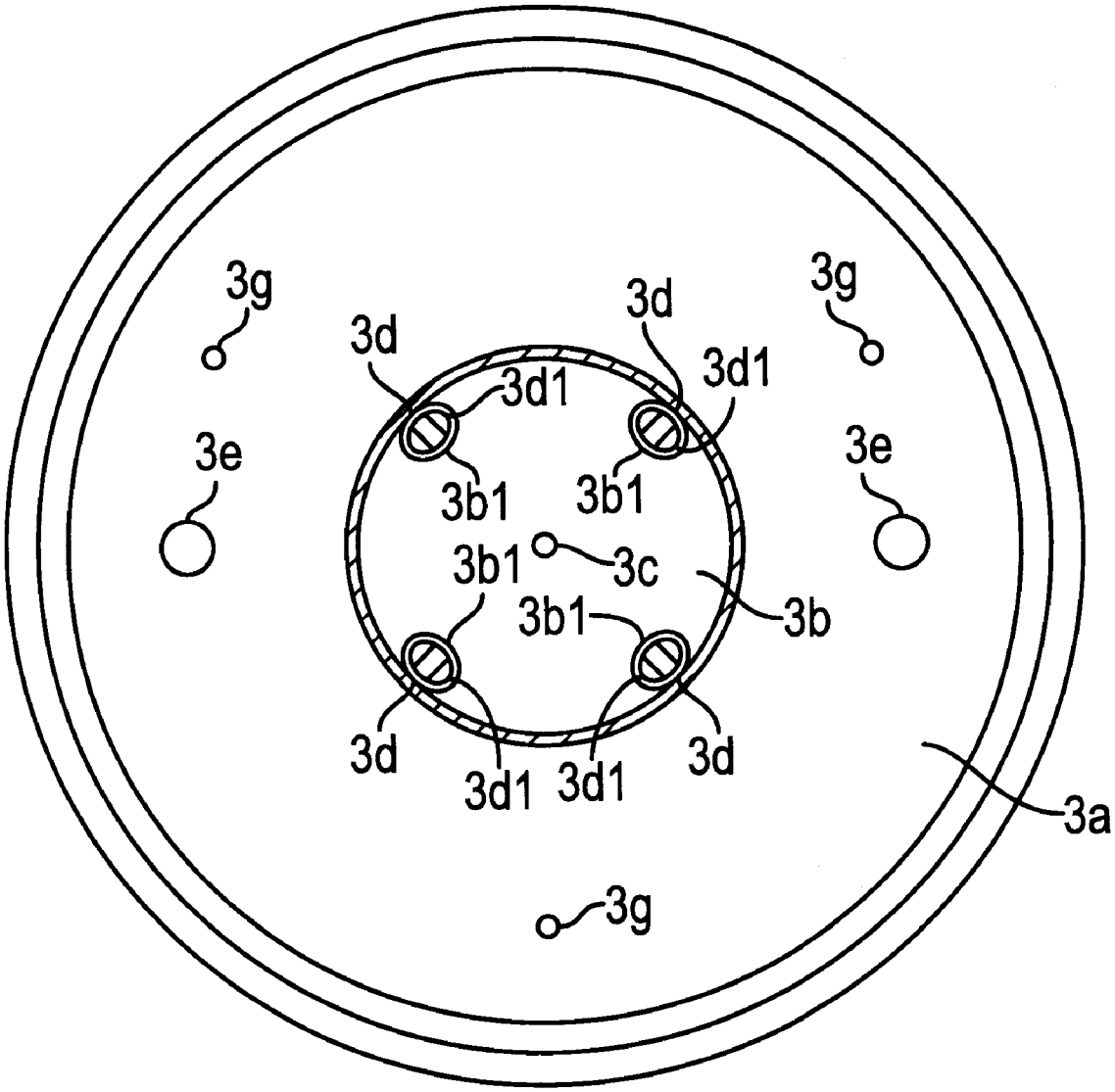
FIG. 7 is a plan view showing the same attachment.

FIG. 6 is a front elevational view showing an attachment of the electric lamp device according to the first embodiment of this invention, and FIG. 7 is a plan view showing the same attachment.

As shown in FIGS. 1 to 3, 6 and 7, the attachment is composed of a plate section 3*a,* light-emitting element mounting section 3*b,* a support standing section 3*c,* projections 3*d,* screw-insertion holes 3*e* and a cylindrical body 3*f*. The plate section 3*a* is fitted in the globe connection opening 1*b*1 of the base body 1*b,* and further, is placed into contact with the circumferential groove 1*b*5 on the globe connection opening 1*b*1 to enlarge the circumferential groove 1*b*5. The light-emitting element mounting section 33*b* is formed at a central portion of the attachment 3 to protrude from the plate section 3*a* toward the globe 1*a* side, where four small holes 3b1 are made at an equal interval. The support standing section 3c is a hole made in the center of the attachment 3. The projections 3d respectively have lead wire insertion grooves 3d1 on its top end portions, and are made close to the small holes 3b1 of the light-emitting element mounting section 3b. The screw insertion holes 3e are made at positions of the plate section 3a facing the bosses 1b6 of the base body 1b.

The cylindrical section 3f protrudes toward the rear surface side of the attachment 3, and is open, with a circumferential groove 3f1 being formed in the circumference thereof. As shown in FIG. 6, a portion of the circumferential groove 3f1 is notched on the plate section side, and a shallow vertical groove 3f2 is formed in an approximately upper half of the width of a portion forming the functional bottom section of the circumferential groove 3f1 in the illustration. An O ring 8 is mounted in the circumferential groove 3f1 (see FIG. 2). The O ring 8 does not normally cross the vertical groove 3f2 portion. The O ring 8 and the circumferential groove 3f1 constitute a waterproof seal means for waterproof-sealing between the cylindrical body 3f and a guide cylindrical section 1b4. In addition, the vertical groove 3f2 organizes a pressure adjusting means.

Furthermore, the attachment 3 is fixed to the base body 1b in a manner that tapping screws 9 are screwed in the bosses 1b6. Still further, three small holes 3g are made in the plate section 3a of the attachment 3 at an interval of 120°. These small holes 3g are for mounting on the attachment 3 by the insertion of the louver supporting means 7.

Meanwhile, if the pressure in the space defined by the globe 1a and the attachment 3 rises while the electric lamp device is on, in FIG. 6 the O ring 8 (not shown) deforms by being pressed upwardly in the notch portion of the circumferential groove 3f1, so that the O ring 8 crosses the vertical groove 3f2. In consequence, the air in the aforesaid space passes through the small holes 3b1 to enter the cylindrical body 3f, and further, travels between the cylindrical body 3f and the guide cylindrical section 1b4 and between the guide cylindrical section 1b4 and the plate section 3a to exit through the small holes 1b9 of the base body 1b to the external.

Incidentally, when the electric lamp device turns off and the interior of the globe 1a cools, although the internal pressure drops, the O ring 8 blocks the air entrance from the external. Accordingly, there is no possibility that dew condensation of the moisture invading from the external in the form of steam, which is due to the respiration caused by the repetition of the turning on and off, occurs within the globe 1.

A description will be given hereinbelow of the small-sized light-emitting element assembly 4. As shown in FIGS. 2 and 3, the small-sized light-emitting element assembly 4 is made up of four baseless small-sized electric lamps 4a acting as the light-emitting elements, intermediate conductors 4b1 for connection between these electric lamps, and a pair of end conductors 4b2 extending from both ends. The baseless small-sized electric lamps 4a are connected in series to each other.

Figure 8:
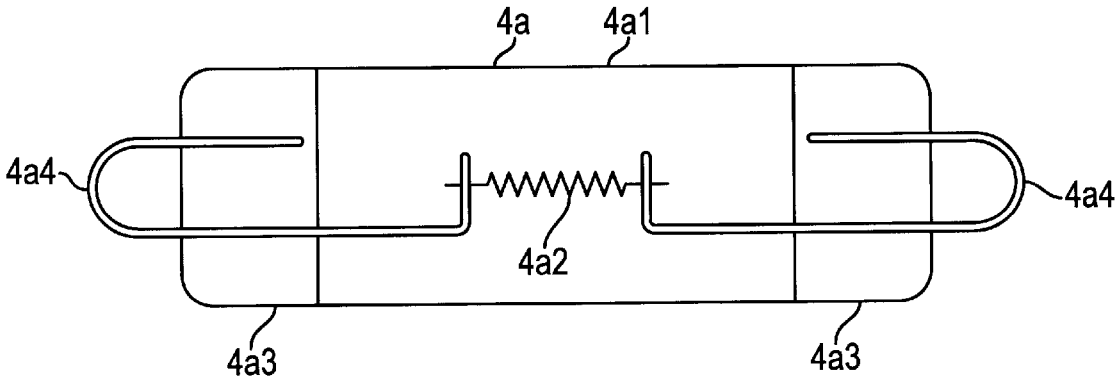
FIG. 8 is a front elevational view showing a baseless small-sized electric lamp of the electric lamp device according to the first embodiment of this invention.

FIG. 8 is a front elevational view showing a baseless small-sized electric lamp of the electric lamp device according to the first embodiment of this invention.

As shown in the illustration, the baseless small-sized electric lamp 4a has a double-sealed structure, and is equipped with a T-shaped elongated bulb 4a1, a filament 4a2 hermetically encased within the bulb 4a1, pinch-sealing type sealing sections 4a3 formed at both ends of the bulb 4a1, and loop-like external lead wires 4a4 guided from the sealing sections 4a3 to the external.

Furthermore, in this embodiment, the baseless small-sized electric lamp 4a is made such that the bulb diameter =10 mm, the total length=43 mm, the nominal rated voltage=26V (xenon is hermetically sealed as an inactive gas), the nominal power consumption=10.6 W, the luminous flux=1121 m, color temperature=2600K and the rated life =6000 hours.

As an available baseless small-sized electric lamp according to a different specification, there is a lamp in which the nominal rated power consumption=10 W, the luminous flux 901 m, the color temperature=2500K, and the rated life 20000 hours. Other structure is the same as that of this embodiment.

The tube axes of the respective baseless small-sized electric lamps 4a are arranged in parallel to the axial direction of the globe 1a and at an equal interval on the same circle around the axis of the globe 1a. Further, the external lead wires 4a4 on the top portion side of the globe 1a are coupled through a pair of intermediate conductors 4b1, 4b1 to each other. Still further, the external lead wires 4a4 on the attachment 3 side are wholly connected in series to each other by the connections of one intermediate conductor 4b1 and a pair of end conductors 4b2. Although not shown in the illustration, the intermediate conductor 4b1 and the end conductors 4b2 are together inserted in the small holes 3b1 of the light-emitting element mounting section 3b. That is, both the ends of the intermediate conductor 4b1 are inserted into the small holes 3b1 from the rear surface side of the attachment 3, and are spot-welded to the external lead wires 4a4 of the baseless small-sized electric lamp 4a on the front surface side of the attachment 3. The end conductors 4b2 at both the ends of the baseless small-sized electric lamp series connection 4 are guided toward the rear surface side of the attachment 3 to be coupled to both terminals of the base 2.

Furthermore, a description will be given hereinbelow of the support 5. As shown in FIG. 2, the support 5 is composed of a strut 5a and an insulating supporting section 5b. The strut 5a is a metallic bar, which is planted in the support standing section 3c of the attachment 3. The insulating supporting section 53b is made of a polyamide resin and fixed to the tip portion of the strut 5a, with a pair of bent grooves 5b1, 5b1 being made in its lower surface.

Furthermore, the intermediate conductors 4b1, 4b1 positioned at the upper portion of the baseless small-sized electric lamp series connection 4 and constituting a first conductor are fitted through an adhesive to the grooves 5b1, 5b1 of the insulating supporting section 5b, if needed.

As mentioned above, the small-sized light-emitting element assembly 4 is, at its upper and lower portions, supported onto the support 5 and the attachment 4 by the intermediate conductors 4b1, and provides a mechanically sufficient strength against vibrations applied from the external.

Moreover, a description will be made hereinbelow of the louver means 6. The louver means 6 includes three ring-like louver components 6a. The ring-like louver components 6a have a circular configuration, and are composed of a upper section 6a1 perpendicular to the axis of the globe 1a and a louver section 6a2 integrally inclined from the outer circumference of the upper section 6a1. Furthermore, in the louver component 6a, its ring surface surrounds the small-sized light-emitting element assembly 4 in a state of being perpendicular to the extending directions of the filaments 4a2 of the baseless small-sized electric lamps 4a. A small interval is made between the respective louver components

6*a* when viewed from the transverse direction. Still further, each of the louver components 6*a* is constructed by shaping an aluminium plate and a white paint film is placed on its inner and outer surfaces.

Figure 12:
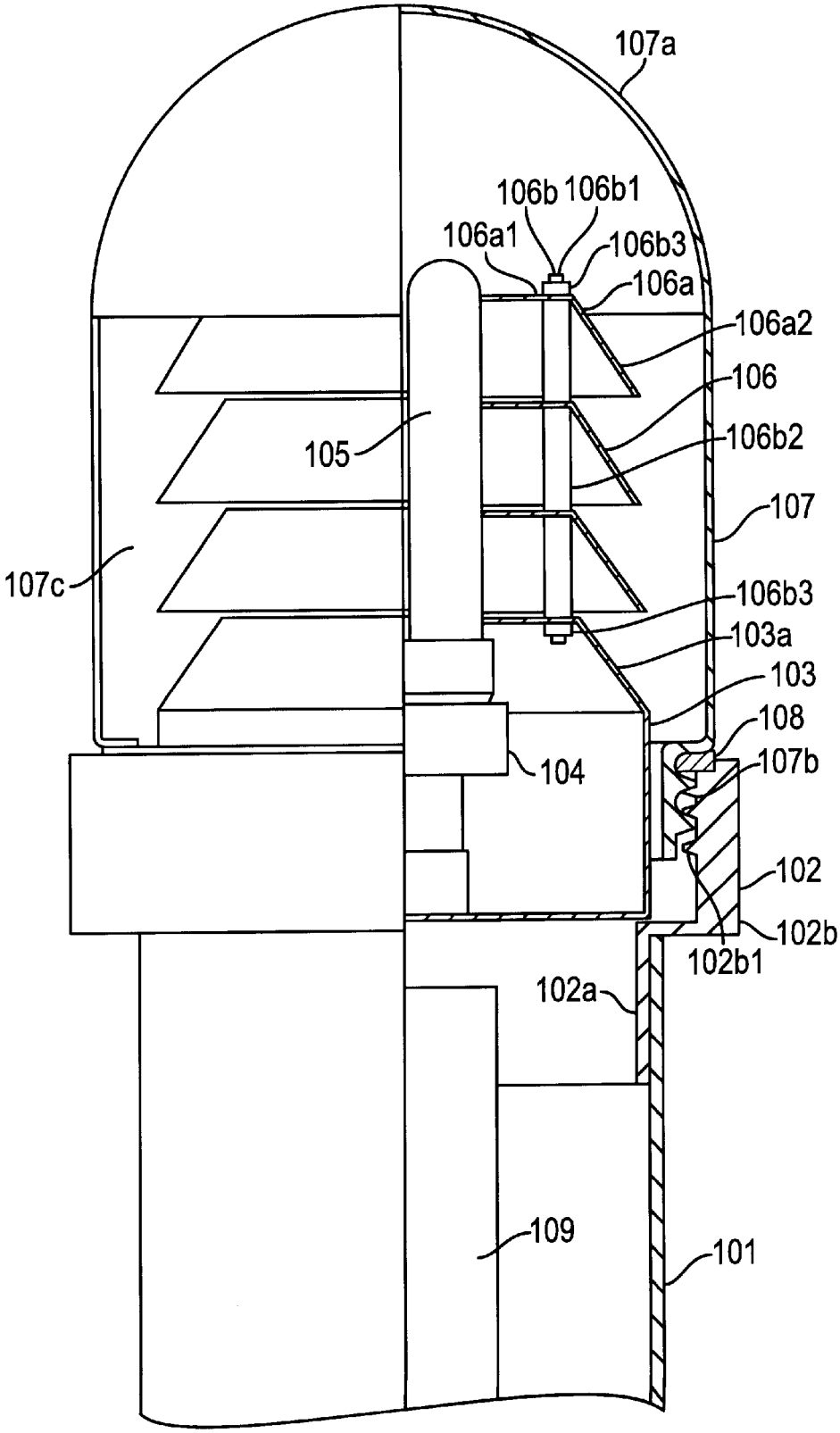
FIG. 12 is a central cross-sectional and front elevational view showing a prior garden light.
Figure 13:
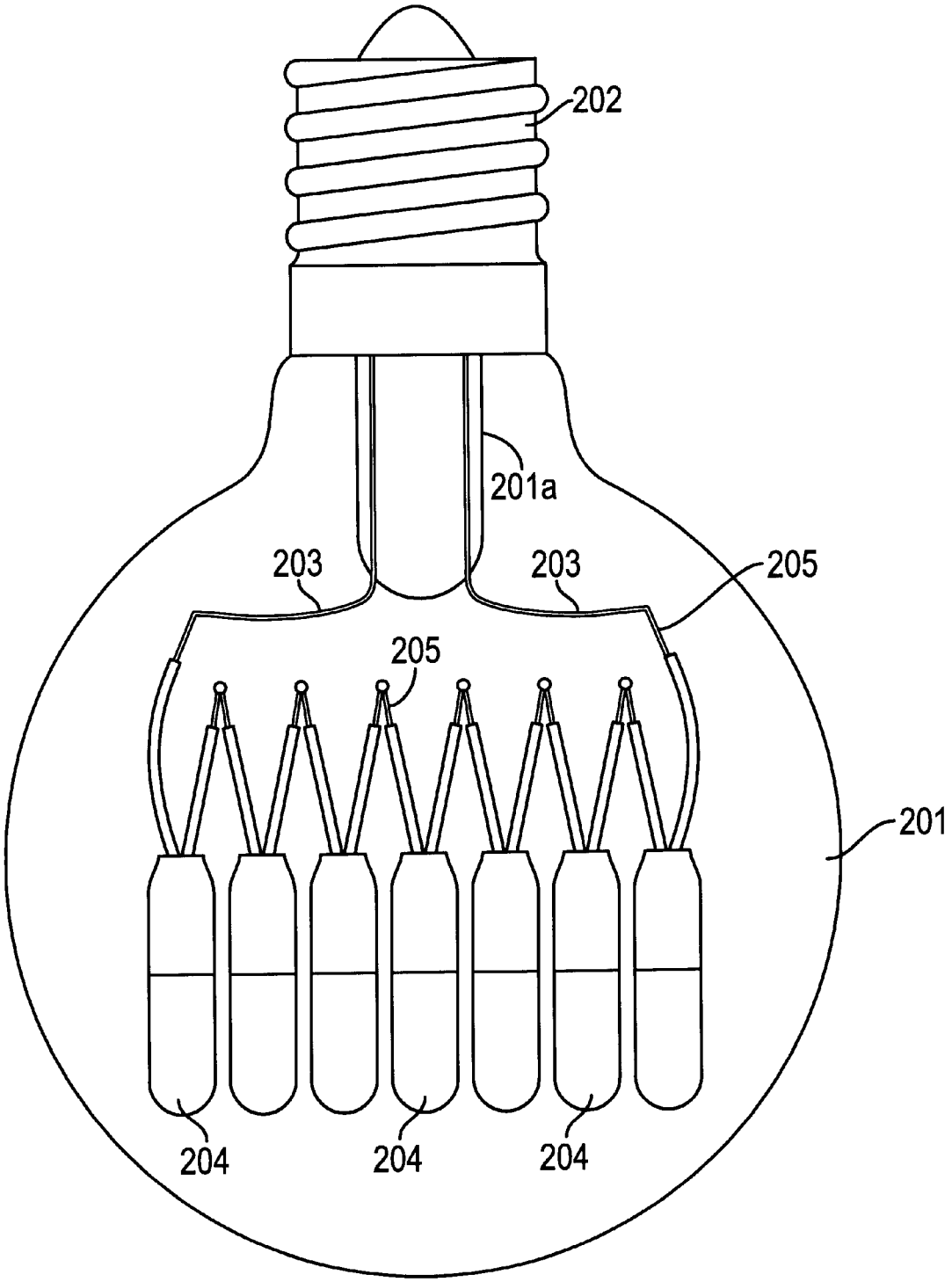
FIG. 13 is a front elevational view showing a prior electric lamp 1 disclosed in Japanese Unexamined Utility Model publication No. 61-138160.
Figure 14:
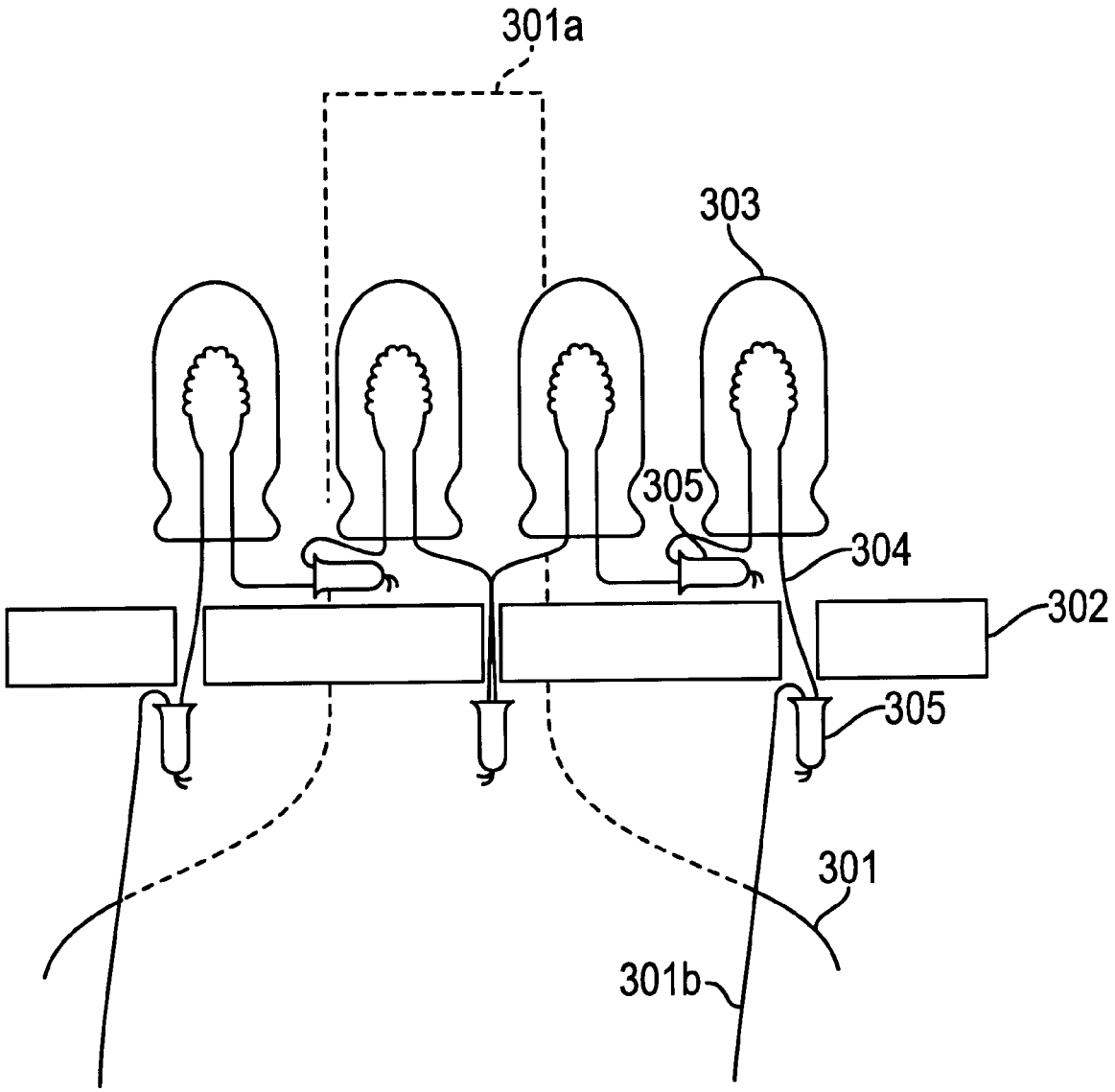
FIG. 14 is a schematic illustration of a principal portion of a prior electric lamp 2 disclosed in Japanese Unexamined Utility Model Publication No. 2-117657.

Furthermore, a description will be given hereinbelow of the louver supporting means 7. The louver supporting means 7 is composed of three stainless steel wire rods surrounding the small-sized light-emitting element assembly 4 at an interval of 120°, and the proximal portion of each of the wire rods is inserted into a small hole 3*g* (see FIG. 7) made in the plate section 3*a* of the attachment 3 and mounted through an adhesive to the attachment 3. Further, the intermediate portion of the wire rod is inserted into a small hole made in the ring-like louver component 6*a* and welding-fixed to the ring-like louver component 6*a*. The tip portion of the wire rod of the louver supporting means 7 is generously turned to form an elastic contact section 7*a* which, in turn, is brought into contact with the inner surface of the top section of the globe 1*a*. The electric lamp with the above-mentioned structure is substantially equal in size to a bulb type fluorescent lamp, where its maximum outer diameter of the globe is 70 mm, its total length is 140 mm and its power consumption is approximately 40 W. As compared with the prior garden light shown in FIG. 12, the maximum outer diameter Is reducible to 47%.

Figure 9:
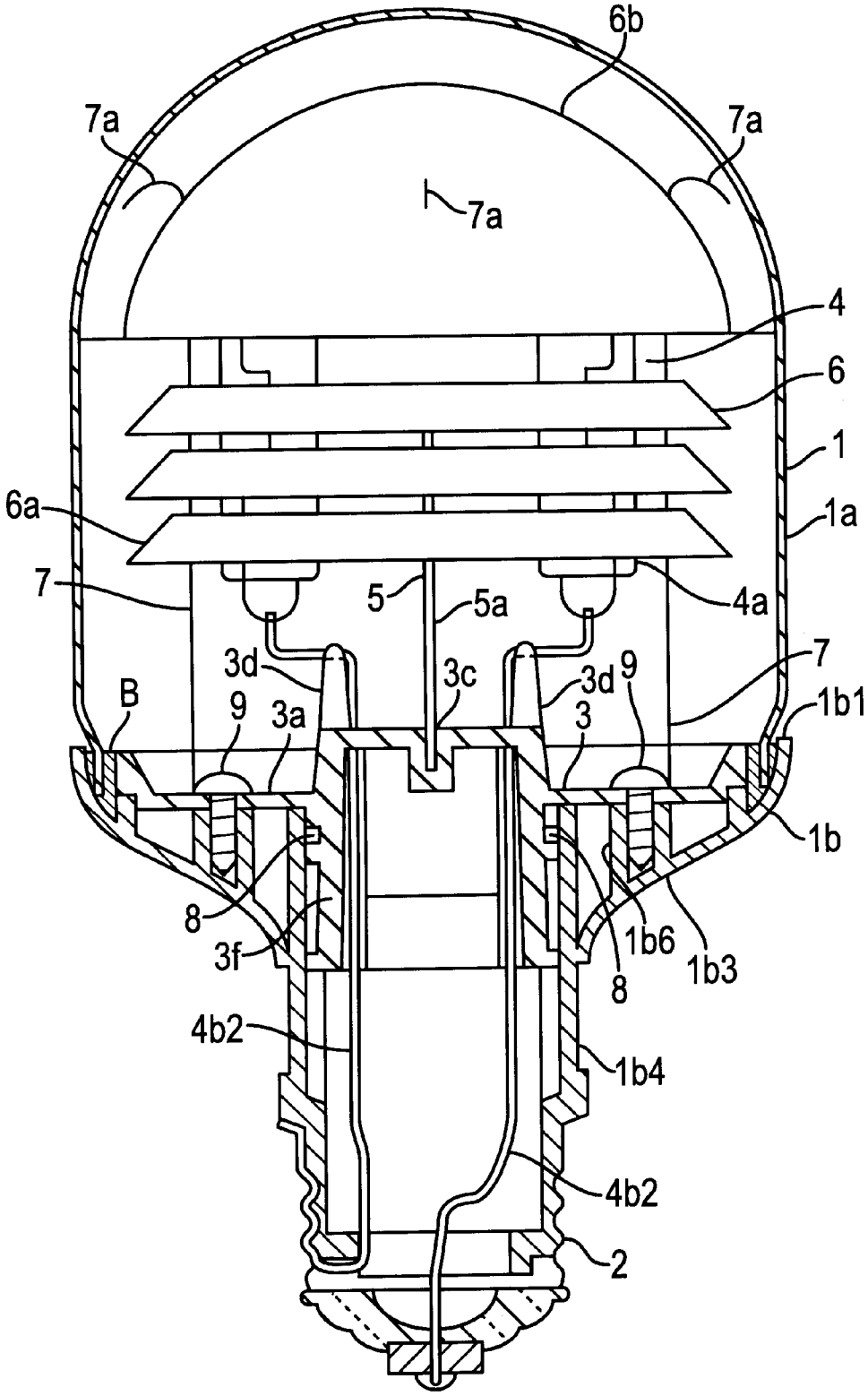
FIG. 9 is a front elevational view showing an electric lamp device according to a second embodiment of this invention.

FIG. 9 is a front elevational view showing an electric lamp device according to a second embodiment of the present invention. In the illustration, the same parts as those in FIG. 2 are marked with the same numerals, and the description thereof will be omitted for brevity.

In this embodiment, the louver means 6 is additionally equipped with a top louver component 6*b,* so that the globe 1*a* is constructed to be transparent as a whole. The top louver component 6*b* is formed into a substantially semi-spherical configuration in a manner of shaping an aluminium plate, and as well as the ring-like louver components 6*a,* a white paint film is placed on its inner and outer surfaces.

Figure 10:
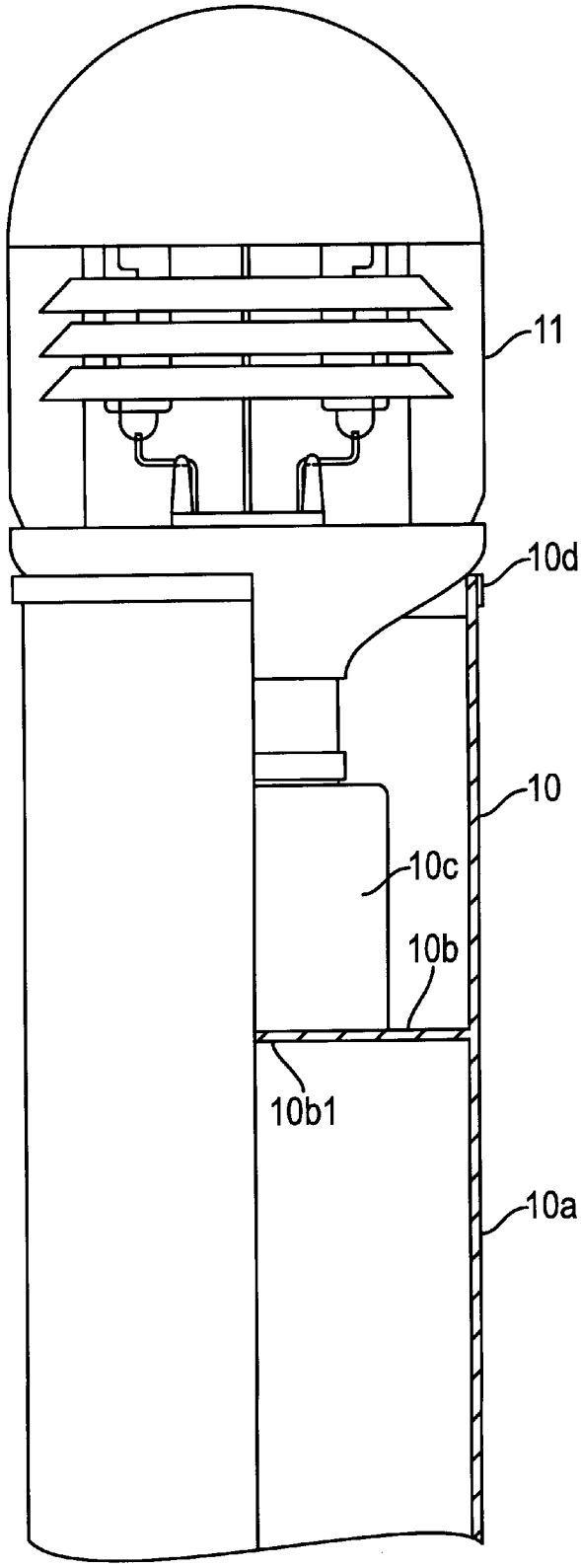
FIG. 10 is a partially broken central cross-sectional and front-elevational view showing a garden light being a lighting apparatus according to a third embodiment of this invention.

FIG. 10 is a partially broken central cross-sectional and front-elevational view showing a garden light being a lighting apparatus according to a third embodiment of this invention. In the illustration, numeral 10 denotes a garden light body, and numeral 11 depicts an electric lamp device. The garden light body 10 comprises a column or strut 10*a,* a partition 10*b,* a socket 10*c* and a packing 10*d*. The column 10*a* has a cylindrical configuration, and its proximal portion is planted in an installation such as the ground. The partition 103*b* is formed within the tip portion of the column 10*a,* and has, at its central portion, a cable insertion hole 10*b*1 for allowing the insertion of a power cable (not shown). The socket 10*c* is fixedly secured to the partition 10*b*. And the packing 10*d* is mounted in a tip edge of the column 10*a*.

The electric lamp device 11 has the same construction as that shown in FIG. 1. When the electric lamp device 11 is screwed in the socket 10*c* from the tip portion side of the column 10*a,* the outer surface of the skirt section 1*b*3 of the base body 1*b* of the electric lamp device 11 is brought into pressurizing contact with the packing 10*d* and the base is set in the socket 10*c,* thus making a garden light. As obvious from the above, the waterproof between the electric lamp device 11 and the garden light body 10 is achievable by the packing 10*d*. The electric lamp device 11 has a diameter of 70 mm, and hence, the column 10*a* can have the approximately same dimension. Since the height of the electric lamp device 11 protruding from the tip portion of the garden light body 10 assumes approximately 85 mm, as compared to the height, i.e., 210 mm, of the pedestal plus the globe in FIG. 12, its height is reducible to 40%.

Figure 11:
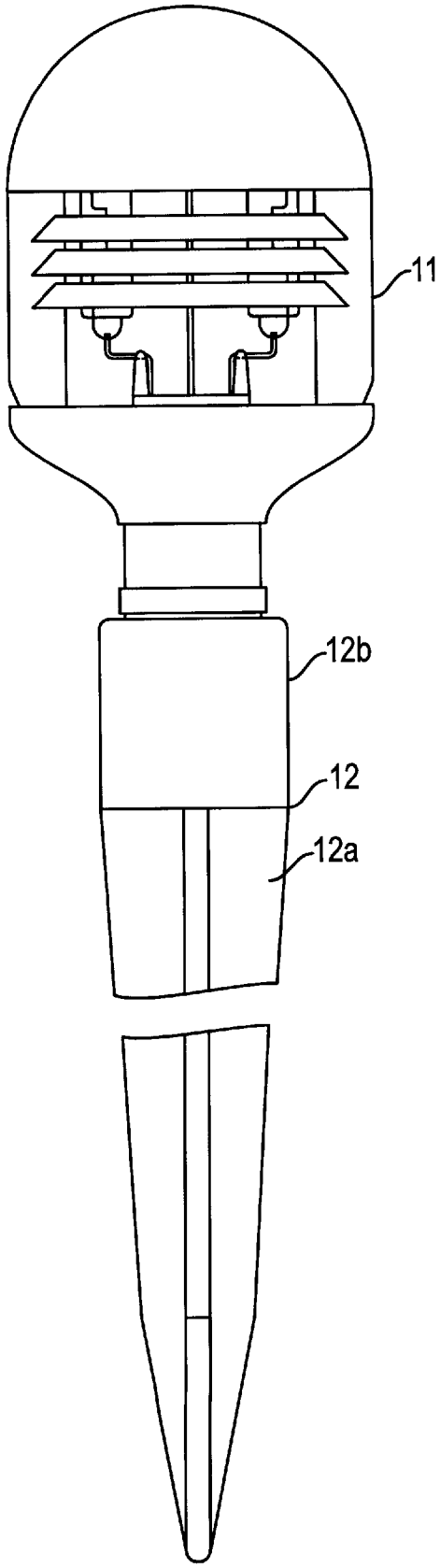
FIG. 11 is a partially broken front elevational view showing a spike light being an lighting apparatus according to a fourth embodiment of this invention.

FIG. 11 is a partially broken front-elevational view showing a spike light being a light apparatus according to a fourth embodiment of this invention. In the illustration, numeral 11 represents an electric lamp device, and numeral 12 designates a spike light body. The spike light body 12 is made up of a spike section 12*a* having a cross-like cross section on its proximal portion side and a socket section 12*b* on its tip portion side.

The spike section 12*a* is inserted into the ground for installation. A power cable guiding hole (not shown) is made in an upper portion of the spike section 12*a,* with a non-shown power cable connected to the socket is drawn out. The socket section 12*b* internally contains a socket and a packing (both not shown). The packing accomplishes the waterproof between the electric lamp device 11 and the base body.

According to the aspects of this invention, an envelope is composed of a globe and a base body, and a small-sized light-emitting element assembly and a louver body surrounding it are housed within the envelope, and hence, it is possible to provide an electric lamp device in which a plurality of small-sized light-emitting elements can provide a sense of glittering, and which, regardless of containing the louver body, can directly be used as a garden light with a feeling of using a common lighting electric lamp, and further which can suppress the light toward the sky.

According to the first aspect of this invention, in addition, the small-sized light-emitting elements are connected in series to each other, and therefore, even if the small-sized light-emitting elements are of a low rated voltage type, they can directly be connected to the main power supply, thus providing an electric lamp device with a simple structure.

According to the second aspect of this invention, additionally, the small-sized light-emitting element assembly is mounted through the use of the attachment to be fitted in a globe connection opening of the base body, and hence, it is possible to provide an electric lamp device easy to assemble.

According to the third aspect of this invention, furthermore, a base is mounted in a power supply connection opening of the base body, which can provide an electric lamp device with the interchangeability with common lighting electric lamps.

According to the fourth aspect of this invention, furthermore, baseless small-sized electric lamps are employed as the small-sized light-emitting elements, so that offering an electric lamp device with a long life and a high efficiency is possible.

According to the fifth aspect of this invention, further, double-end sealing type baseless small-sized electric lamps are used and the louver means is disposed so that the ring surfaces of the ring-like louver components cross the longitudinal direction of the filaments, thus providing an electric lamp device which can accomplish an effective light distribution.

According to the sixth aspect of this invention, the use of baseless small-sized electric lamps where xenon is sealed can produce an electric lamp device providing a longer life, a high optical efficiency, a high color temperature and a sharp light color.

According to the seventh aspect of this invention, furthermore, a plurality of wire rods are used as the louver supporting means, so that it is possible to offer an electric lamp device in which the ring-like louver component supporting construction becomes simplified.

According to the eighth aspect of this invention, additionally, the tip portions of the wire rods organizing the louver supporting means are brought into elastic contact with the inner surface of the globe, with the result that, even if the wire rods are thin, it is possible to provide an electric lamp means in which the louver means can be supported certainly.

The ninth aspect of this invention provides an electric lamp device which is capable of easily making waterproof and of making the charging section protection for the built-in parts unnecessary to simplify its structure in a manner that the globe is adhered to the base body.

The tenth aspect of this invention provides an electric lamp device which is capable of, because of the installation of a light-intercepting means on the top portion of the globe, suppressing the obstruction light toward the sky to prevent troubles caused by light.

The eleventh aspect of this invention provides an electric lamp device which is capable of, because of the formation of a metal-deposited-film made light-intercepting means on the top portion of the globe, increasing the effective light quantity while intercepting light.

The twelfth aspect of this invention provides an electric lamp device which is capable of, because of the addition of a top louver to the louver body and the employment of the wholly transparent globe, improving its appearance.

The thirteenth aspect of this invention provides an electric lamp device which is capable of, because that the louver surfaces of the louver components are inclined toward the power supply connection opening side, excellently illuminating the foot side in a state where the top portion of the globe is directed upwardly.

The fourteenth aspect of this invention offers a light apparatus with the above-mentioned first to thirteenth aspects.

It should be understood that the foregoing relates to only preferred embodiments of the present invention, and that it is intended to cover all changes and modifications of the embodiments of the invention herein used for the purpose of the disclosure, which do not constitute departures from the spirit and scope of the invention.

What is claimed is:

1. An electric lamp device comprising:

an envelope having:

a globe having an open end at one end portion thereof and further having a transparent section; and a base body having a globe connection opening at one end portion thereof and a power supply connection opening at the other end portion thereof, said globe connection opening being connected to said open end of said globe;

a light-emitting element assembly made up of a plurality of light-emitting elements connected in series to each other, and housed in said envelope with conductors at both ends leading to the power supply connection opening;

a louver assembly located within the globe including at least two, internal annular louver components, each louver component having a circular configuration and comprising an upper section perpendicular to an axis of said globe and a louver section integral with said upper section and inclined away from an outer circumference of said upper section, said louver components disposed to surround said light-emitting element assembly elements within said envelope; and louver supporting means located within the globe for supporting said louver assembly at a predetermined position with said louver components spaced from each adjacent louver component by an interval along the axis.

2. An electric lamp device as defined in claim 1, wherein each of said light-emitting elements of said small-sized light-emitting element assembly is constructed as a baseless small-sized electric lamp.

3. An electric lamp device as defined in claim 2, wherein each of said baseless small-sized electric lamps is of a double-end sealing type where its filament substantially extends in parallel to the axis of said globe, and said louver means is constructed such that ring surfaces of its ring-like louver components are disposed to cross said filament.

4. An electric lamp device as defined in claim 2, wherein said baseless small-sized electric lamp is constructed such that xenon is sealed in a glass bulb.

5. An electric lamp device as defined in claim 1, wherein said louver supporting means is constructed with a plurality of wire rods in which their proximal portions are fixed to the base body side and their intermediate sections support said ring-like louver components.

6. An electric lamp device as defined in claim 5, wherein said louver supporting means is constructed such that a tip portion of each of said wire rods is placed into resilient contact with an inner surface of said globe.

7. An electric lamp device as defined in claim 1, wherein said open end of said globe is adhered to said globe connection opening of said base body.

8. An electric lamp device as defined in claim 1, wherein said globe is, at its top portion, equipped with light-intercepting means.

9. An electric lamp device as defined in claim 8, wherein said light-intercepting means on said top portion of said globe is made by a metal deposited film.

10. An electric lamp device as defined in claim 1, wherein said globe is substantially transparent as a whole, and said louver means includes a top louver component positioned on a further globe top portion side with respect to said ring-like louver components.

11. An electric lamp device as defined in claim 1, wherein said louver means is constructed such that said ring-like louver component has a louver surface inclined toward said power supply connection opening of said base body.

12. A lighting apparatus comprising:

a lighting apparatus body: and an electric lamp device having the same structure as claim 1, and supported by said lighting apparatus body.

13. An electric lamp device comprising:

an envelope having:

a globe having an open end at one end portion thereof and further having a transparent section; and a base body having a globe connection opening at one end portion thereof and a power supply connection opening at the other end portion thereof, said globe connection opening being connected to said open end of said globe;

an attachment including a plate section fitted in said globe connection opening of said base body and a light-emitting element mounting section;

a light-emitting element assembly made up of a plurality of light-emitting elements, mounted on said light-emitting element mounting section of said attachment and housed in said envelope;

a louver assembly located within the globe including annular louver components, each louver component having a circular configuration and comprising an upper section perpendicular to an axis of said globe and a louver section integral with said upper section and inclined from the outer circumference of said upper section, said louver components being separated from each other in an axial direction of said envelope and surrounding said light-emitting element assembly within said envelope; and louver supporting means located within the globe for supporting said louver assembly at a predetermined position.

14. An electric lamp device comprising:

an envelope having:

a globe having an open end at one end portion thereof and further having a transparent section; and a base body having a globe connection opening at one end portion thereof and a power supply connection opening at the other end portion thereof, said globe connection opening being connected to said open end of said globe;

a base mounted in said power supply connection opening of said base body;

a light-emitting element assembly made up of a plurality of light-emitting elements and housed in said envelope;

a louver assembly located within the globe including annular louver components, each louver component having a circular configuration and comprising an upper section perpendicular to an axis of said globe and a louver section integral with said upper section and inclined from the outer circumference of said upper section, said louver components being separated from each other in an axial direction of said envelope and surrounding said light-emitting element assembly within said envelope; and louver supporting means located within the globe for supporting said louver assembly at a predetermined position.

* * * * *